US008762140B2

(12) United States Patent
Saguin

(10) Patent No.: US 8,762,140 B2
(45) Date of Patent: Jun. 24, 2014

(54) DEVICE FOR IMPROVING THE INTELLIGIBILITY OF SPEECH IN A MULTI-USER COMMUNICATION SYSTEM

(75) Inventor: Pascal Saguin, Saint Pierre d'Allevard (FR)

(73) Assignee: Adeunis RF, Crolles (FR)

( * ) Notice: Subject to any disclaimer, the term of this patent is extended or adjusted under 35 U.S.C. 154(b) by 239 days.

(21) Appl. No.: 13/379,451

(22) PCT Filed: Jun. 22, 2010

(86) PCT No.: PCT/FR2010/000457

§ 371 (c)(1),
(2), (4) Date: Dec. 20, 2011

(87) PCT Pub. No.: WO2010/149875

PCT Pub. Date: Dec. 29, 2010

(65) Prior Publication Data

US 2012/0116760 A1 May 10, 2012

(30) Foreign Application Priority Data

Jun. 23, 2009 (FR) ..... 09 03038

(51) Int. Cl.
*G10L 21/0208* (2013.01)

(52) U.S. Cl.
CPC ..... *G10L 21/0208* (2013.01)
USPC ..... 704/227

(58) Field of Classification Search
CPC ..... G10L 21/0208
USPC ..... 704/227
See application file for complete search history.

(56) References Cited

U.S. PATENT DOCUMENTS

| | | | | |
|---|---|---|---|---|
| 4,860,366 | A * | 8/1989 | Fukushi et al. | 381/106 |
| 7,395,060 | B2 * | 7/2008 | Liu | 455/423 |
| 2005/0060142 | A1 | 3/2005 | Visser et al. | |
| 2009/0003586 | A1 | 1/2009 | Lai et al. | |

FOREIGN PATENT DOCUMENTS

| | | | |
|---|---|---|---|
| EP | 1 843 326 | A1 | 10/2007 |
| WO | WO 00/74350 | A2 | 12/2000 |

* cited by examiner

*Primary Examiner* — Susan McFadden
(74) *Attorney, Agent, or Firm* — Oliff PLC

(57) ABSTRACT

A device for improving the intelligibility of a signal arising from a source subjected to a noisy environment, said source marking the signal with a specific signature, the device comprising a processing circuit receiving the signal; and means for analyzing the signal and parameterizing the processing circuit according to characteristics of the signature present in the signal. A first channel with low distortion conveys the signal from the source to the means for analyzing, and a second channel, susceptible to introduce a distortion, conveys the signal from the source to the processing circuit.

8 Claims, 2 Drawing Sheets

DEVICE FOR IMPROVING THE INTELLIGIBILITY OF SPEECH IN A MULTI-USER COMMUNICATION SYSTEM

BACKGROUND OF THE INVENTION

The invention relates to a communication system enabling several users to be connected in conference mode, i.e. each user is able to speak and at the same time hear all the other users. The invention relates more particularly to a device for improving the intelligibility of speech when the users are speaking in a noisy environment, for example a sporting event in a stadium.

STATE OF THE ART

In a multi-user communication system suitable for a noisy environment, it is desired to transcribe speech in intelligible manner and to attenuate the ambient noise, in particular during mute phases. Indeed, if each terminal were permanently transmitting the ambient noise, each terminal would receive the sum of the noises picked up by all the other terminals, this problem being aggravated when the number of users increases.

A well-known solution for eliminating noise during mute phases is that used by walkie-talkies, i.e. the user switches his terminal between a transmission-only mode and a reception-only mode by means of a button. However, this solution is unadapted when the number of users who are liable to speak is more than three, it is constraining as it monopolizes one of the user's hands, and it does not enable a user who is speaking to hear an important message which may be transmitted by another user.

Recourse is therefore being had to communication systems operating in conference mode wherein each terminal is capable of detecting the user's speech and of removing the ambient noise from the signal. Patent application EP 1843326 describes such a system.

FIG. 1 represents a block diagram of a terminal as described in patent application EP 1843326. A microphone 10 transmits the speech signal of the user to an amplifier 12. The signal is then pre-filtered, in step 14, in order to remove the components outside the speech band, and is then converted into digital form by an analog-to-digital converter 16. The converted signal is then supplied to a digital signal processing circuit (DSP).

The DSP is programmed to perform the envisaged signal processing operations, in particular improving the intelligibility of speech. An example of processing is described in the above-mentioned patent application. It involves detection of the speech signature and calculation of parameters of a filter which enables the ambient noise to be removed from the signal while at the same time preserving the speech signal.

The signal output from the DSP is conveyed to an antenna 18 trough a RF transmission module 20, which performs the required processing operations to convert the digital signal provided by the DSP into a signal transmissible to the antenna, according to the standard used by all the terminals.

Antenna 18 also receives the signals emitted by other terminals, which RF module 20 converts and transmits to the DSP. These received signals are processed by the DSP and sent to a loudspeaker 22 via a shaping circuit 24 which performs digital-to-analog conversion, filtering, and amplification.

A terminal of the type of FIG. 1 is efficient in terms of intelligibility of speech and noise elimination, provided that the gain of amplifier 12 is always adjusted to match the type of microphone and that the microphone is located at a precise location with respect to the user's mouth 12. Any deviation can be drastically detrimental to the efficiency of the terminal.

The use for example of a lapel mike, with which the speech measurement conditions will vary over time according to the user's movements and to the orientation of his/her head, is therefore excluded.

If the user wishes to change microphone, the gain of amplifier 12 has to be adjustable, for example by means of a potentiometer. This is not compatible with equipment that needs to be ready to operate at any time.

SUMMARY OF THE INVENTION

A need therefore exists for a terminal designed for use in a noisy environment, enabling a great freedom of placing of the microphone. A need also exists to enable the use of several types of microphone without the user having to perform adjustments.

To satisfy at least one of these needs, a device is provided for improving the intelligibility of a signal arising from a source subjected to a noisy environment, said source marking the signal with a specific signature, said device comprising a processing circuit receiving the signal and means for analyzing the signal and for parameterizing the processing circuit according to characteristics of the signature present in the signal. The device comprises a first channel with low distortion conveying the signal from the source to the means for analyzing, and a second channel susceptible to introduce a distortion, conveying the signal from the source to the processing circuit.

BRIEF DESCRIPTION OF THE DRAWINGS

Other advantages and features will become more clearly apparent from the following description of particular embodiments of the invention, given for non-restrictive example purposes only and represented in the appended drawings in which.

DESCRIPTION OF A PREFERRED EMBODIMENT OF THE INVENTION

In a situation where it is desired to match the signal processing channel with a source which may have a large range, it is commonplace to use a variable gain input amplifier in a negative feedback loop adjusting the gain according for example to the envelope of the signal.

Nevertheless, in situations where the ambient noise can undergo sharp amplitude variations, for example in a stadium during a sporting event, the amplifier gain adjustment does not react fast enough to prevent saturation of the channel (the reaction time of the loop is moreover deliberately slow to reduce the distortion under nominal conditions of use).

Figure 1:
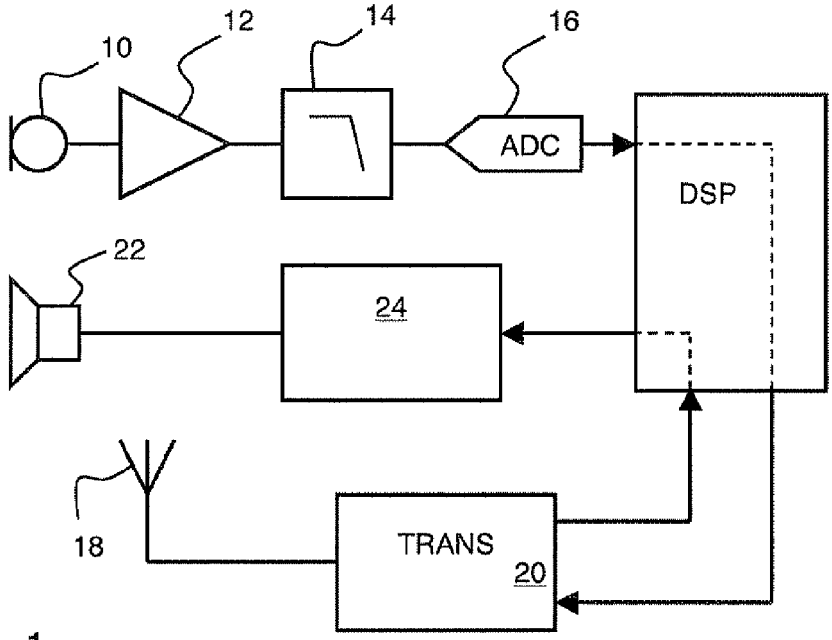
FIG. 1, previously described, represents a block diagram of a conventional terminal able to be used in a multi-user communication system of conference type.

This solution with a variable gain amplifier is proved unsuitable in a terminal of the type of FIG. 1 (under the conditions where it is desired to be used) to compensate variations of location of the microphone. Saturation of the processing channel does in fact disturb speech signature detection to such an extent that it gives rise to numerous false detections and consequently to inefficient noise filtering.

To prevent saturation in such situations, recourse is often had to a dynamic range compressor, which is an amplifier having a non-linear gain curve flattened asymptotically towards the saturation limit.

Nevertheless, a dynamic range compressor introduces such a distortion that speech signature detection is seriously disturbed in the event of saturation.

Figure 2:
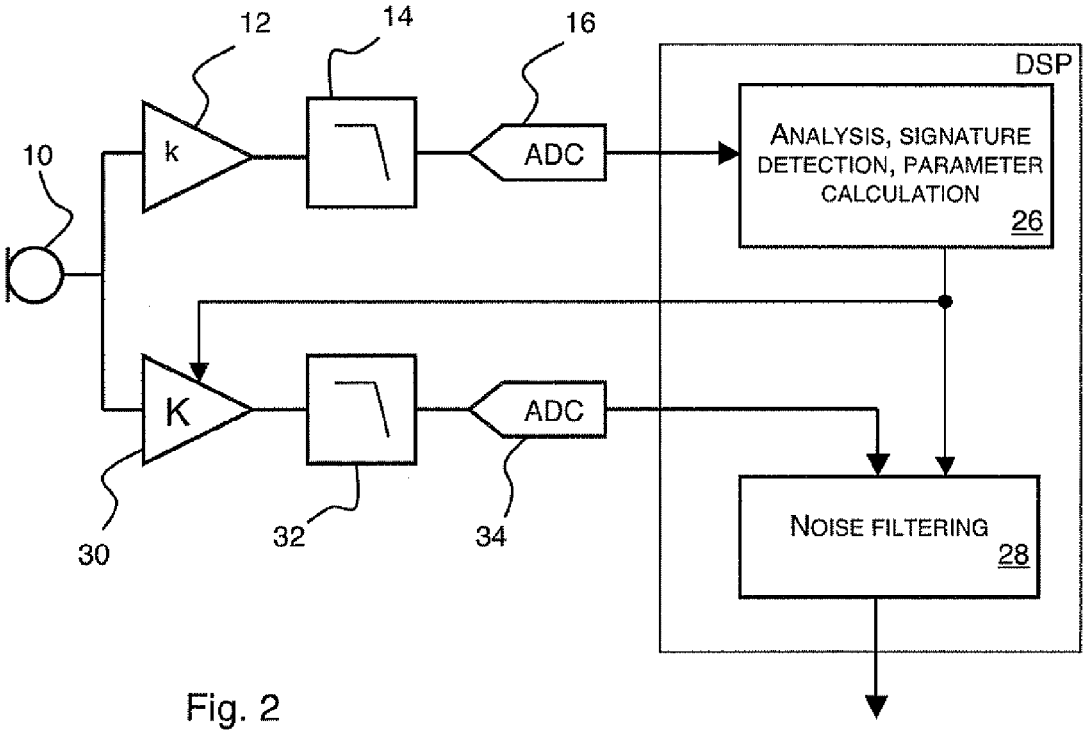
FIG. 2 represents a block diagram of an embodiment of a terminal forming the object of the present patent application.

FIG. 2 represents components of a terminal incorporating an embodiment of a microphone location compensation system. Some components of the terminal of FIG. 1 are present, designated by the same reference numbers.

The signal from microphone 10 is transmitted to the DSP by a first channel incorporating amplifier 12, filter 14 and convertor 16 described in relation with FIG. 1. Gain k of amplifier 12 is chosen sufficiently low for saturation of the channel to be unlikely, or for saturation to occur sometimes but only for short periods. This gain k does however have to be sufficient for a speech signal coming from a microphone placed far from the mouth to be able to be processed by the DSP.

In other words, it is desired for the first channel to present a low distortion over the whole input signal range. In this case, even if the signals are of low amplitude, the DSP will be able to detect the speech signature.

This first channel is analyzed by a process 26 of the DSP which detects the speech signature and calculates the filter parameters according to the characteristics of the signature. These calculations can be similar to those described in patent application EP 1843326.

Furthermore, the signal from microphone 10 is transmitted to a second process 28 of the DSP by a second channel comprising an amplifier 30 with gain K, a filter 32 attenuating the frequencies outside the speech band, and an analog-to-digital converter 34.

Gain K of amplifier 30 is chosen such as to produce a speech signal that is audible under most conditions. It is of little importance if the channel saturates on ambient noise peaks, as this channel is not used for speech detection. Preferably, as represented, gain K is variable and is controlled by process 26 so as to adjust the amplitude of the signal as best as possible to the dynamic range of the second channel. The gain is determined for example according to the envelope of the signal conveyed in the first channel.

As the distortions introduced by the second channel do not affect the reliability of signature detection, a dynamic range compressor, for example incorporated in amplifier 30, can also be inserted therein. A dynamic range compressor will introduce a greater distortion in situations where the channel would not be saturated, but it has the advantage of producing a more intelligible signal in saturation situations.

Process 28 implemented by the DSP on the second channel performs noise filtering using the parameters calculated by process 26. This filtering can, as in patent application EP 1843326, consist in removing the ambient noise from the signal, thereby preserving the speech signal.

Removal of the ambient noise during mute phases generally does not manage to totally eliminate the signal, so that the terminals continue to emit a certain noise level during these phases. The sum of these noises can become non-negligible in the presence of a large number of terminals. This drawback can be avoided as will be seen in relation with the following figure.

Figure 3:
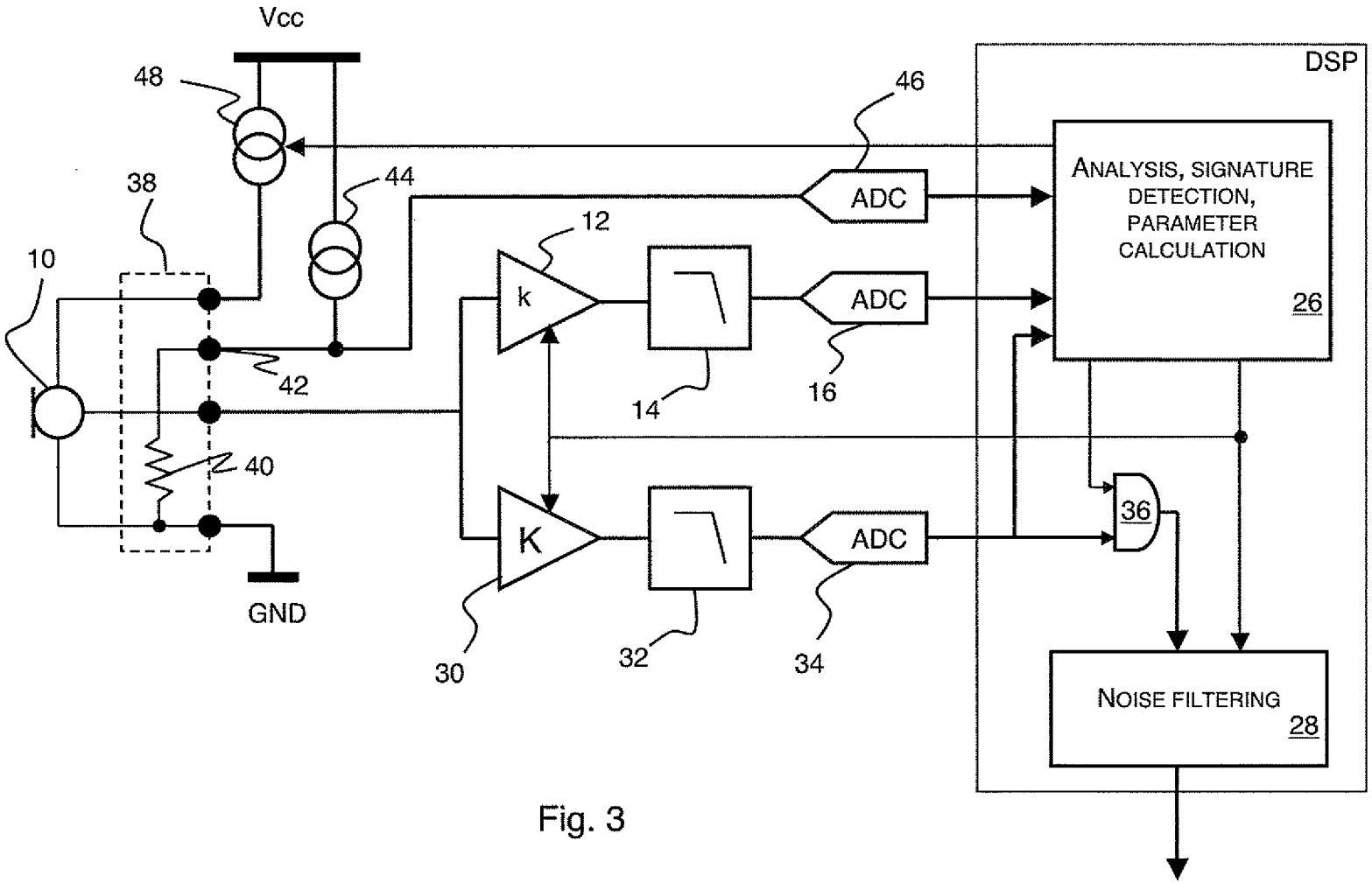
FIG. 3 represents improvements that can be made to the embodiment of FIG. 2.

FIG. 3 represents the device of FIG. 2 on which several improvements have been made. These improvement can be used together or separately.

To improve the noise level situation during mute phases, it is provided to disable the output of the second channel during the phases where process 26 does not detect a speech signature. This functionality is symbolized by a gate 36 located in second channel 30, 32, 34 upstream of filtering process 28.

As stipulated in the foregoing, a trade-off has to be made in the choice of gain k of amplifier 12 of the first channel so as to obtain a sufficient signal amplitude to detect a speech signature in the case where the microphone is far from the mouth, and not to saturate the channel too much in the case where the microphone is close to the mouth.

This trade-off is not difficult to achieve when the terminal is scheduled to use a single type of microphone. Users may however want to use different types of microphone, which differ in particular by their sensitivity. In this case, a trade-off for gain k is more difficult to find. The gain of amplifier 12 will preferably be adjusted to the sensitivity of the microphone. This can naturally be achieved by providing a manual gain adjustment, such as a selector switch, but this goes against this type of terminal which has to be ready to operate under all circumstances.

It will therefore be preferred to equip the terminal with automatic detection of the type of microphone. Professional-quality microphones which are used with terminals of this type are not equipped with connectors, so that the manufacturer of the terminals can equip them with the connectors of their choice. It is provided here to equip the microphones with a connector comprising an identification system.

In FIG. 3, microphone 10 is equipped with a connector 38 incorporating for example a resistor 40 of specific value associated with the type of microphone. This resistor is connected between a ground terminal GND of the connector and an identification terminal 42 of the connector.

Inside the terminal, identification terminal 42 is connected to a supply voltage Vdc by a current source 44. The voltage drop at the terminals of resistor 40, which is proportional to the value of the resistor, is converted into digital form by a converter 46 and analyzed by process 26.

According to the type of microphone identified by resistor 40, process 26 adjusts gain k of amplifier 12 and possibly other parameters, such as the bias current necessary for electret microphones. The bias current is supplied for example by a current source 48 connected between voltage Vdc and a dedicated terminal of connector 38.

As represented, analysis process 26 also receives the signal coming from the second channel. This enables finer signature detection and filter parameter determination algorithms to be implemented in analysis process 26, if required.

Although the emphasis in the foregoing description has been placed on eliminating the audible ambient noise, it can be understood that the system is just as efficient to eliminate noise of a different nature, in particular the noise generated by the electronic circuits themselves, provided that the noise is not consistent with the signature that is to be detected. Such noise, which may prove to be inconvenient, is the burst noise induced by the antenna in the audio acquisition channel. Burst noise is the noise of audible frequency generated by the envelope of the RF signals which alternate between transmission and receipt.

Speech signature detection has so far been considered. The system described here can however also apply to detection of other signatures. In a use of the system by referees of a sporting event, it may prove useful to detect whistle blows to trigger stopping and starting of a stopwatch. Process 26 can thus be provided to also detect the signature of a whistle. In this case, the purpose of signature detection is to trigger a signal which can be sent to a particular terminal which will make the desired use of the signal.

Furthermore, having a first audio acquisition channel which remains linear means that an echo suppression function can be further provided in the terminal, and that an "open" loudspeaker (a loudspeaker whereof the sound is able to be picked up by the microphone) can therefore be used.

Numerous variants and modifications of the system described here will be apparent to the person skilled in the art. The system has been described in relation with wireless terminals designed to transmit the human voice. It is however not excluded to use these principles in a wired system to process signal sources other than a voice picked up by a microphone.

The invention claimed is:

1. A device for improving the intelligibility of a signal arising from a source subjected to a noisy environment, said source marking the signal with a specific signature, device comprising:

a processing circuit receiving the signal; and a signal analyzer parameterizing the processing circuit according to characteristics of the signature present in the signal;

a first channel with low distortion conveying the signal from the source to the analyzer;

a second channel susceptible to introduce a distortion and conveying the signal from the source to the processing circuit; and a variable gain amplifier located upstream of the second channel, controlled by the analyzer according to the amplitude of the signal in the first channel.

2. The device according to claim 1, comprising a circuit configured to disable the second channel when the analyzer do not detect the signature in the first channel.

3. The device according to claim 1, comprising a dynamic range compressor located in the second channel.

4. The device according to claim 1, comprising an amplifier located upstream of the first channel, said amplifier having a gain such that the first channel has a low probability of saturating.

5. The device according to claim 4, wherein the source is a speech signal picked up by a microphone, the signature to be detected by the analyzer being the signature of speech.

6. The device according to claim 5, comprising an identification system for identifying the type of microphone and for adjusting the gain of the amplifier of the first channel according to the identified type.

7. The device according to claim 6, comprising a connector to receive the microphone, the connector having dedicated terminals designed to convey an identification signal of the type of microphone.

8. The device according to claim 5, wherein the analyzer is designed to further detect a signature of a whistle.

* * * * *